United States Patent [19]

Marforio

[11] 4,089,280

[45] May 16, 1978

[54] SEWING MACHINE WORK GUIDE FOR AUTOMATICALLY FORMING A SEAM ALONG A CURVED PATH

[75] Inventor: Nerino Marforio, Milan, Italy

[73] Assignee: Rockwell-Rimoldi, S.p.A., Milan, Italy

[21] Appl. No.: 710,553

[22] Filed: Aug. 2, 1976

[30] Foreign Application Priority Data

Sep. 11, 1975 Italy ..... 27121/75

[51] Int. Cl.[2] ..... D05B 35/10

[52] U.S. Cl. ..... 112/153

[58] Field of Search ..... 112/153, 136, 140, 203; 226/196

[56] References Cited

U.S. PATENT DOCUMENTS

| | | | |
|---|---|---|---|
| 3,377,967 | 4/1968 | Szentkuti et al. | 112/153 X |
| 3,808,993 | 5/1974 | Heiler et al. | 112/153 X |
| 3,814,039 | 6/1974 | Heiler et al. | 112/153 |
| 3,970,017 | 7/1976 | Babson et al. | 112/153 X |

*Primary Examiner*—Werner H. Schroeder
*Assistant Examiner*—Peter Nerbun

[57] ABSTRACT

A device for automatically guiding a workpiece, having a profile of pronounced curved configuration, to the sewing instrumentalities of a sewing machine. The device includes a first channel for guiding the edge of the workpiece in which a seam is to be formed, and a second channel communicating with the first for receiving, retaining and guiding that portion of the workpiece subjected to puckering during seaming so as to prevent such puckering from being incorporated into the seam.

2 Claims, 4 Drawing Figures

SEWING MACHINE WORK GUIDE FOR AUTOMATICALLY FORMING A SEAM ALONG A CURVED PATH

BACKGROUND OF THE INVENTION

The present invention pertains to a sewing machine work guide for forming a seam of stitches along an edge having a concave profile.

More specifically, the work guide according to the invention is used to produce a seam along paths having a very marked concave curvature, for example, the seam between the rear portion of pants or the front connection of the same.

This sewing operation has conventionally been carried out manually by means of the operator keeping the edge to be sewn stretched out against the vertical guide wall of a conventional guide to prevent the puckers formed in the material from moving the edge away from the guide wall and also to prevent these puckers from being inserted beneath the presser foot of the sewing machine. It has been found that, as a result of the unavoidable puckering of the fabric being sewn, the seam is often formed outside of the edge corresponding to the most marked curvature of the profile and that the puckers are sewn into the seam of stitches.

The object of the present invention is to eliminate the above disadvantages and to produce a seam along edges having a concave profile, without necessitating the manual intervention of the operator.

The technical problem solved by the present invention is that of keeping only the edge of the workpiece, in which the seam is to be sewn, perfectly flat, while enabling the inevitable puckering of the fabric to take place solely in a zone clear of the presser foot.

SUMMARY OF THE INVENTION

The above technical problem is solved by means of a guide according to the present invention for automatically producing a seam along profiles having a concave curvature on sewing machines having the usual presser foot and work surface. The guide according to the invention includes a vertical wall disposed perpendicular to the work surface and is located to the right of the sewing axis. It also includes an upper wall which projects beyond the vertical wall so as to form with the work surface, a guide channel for guiding the fabric towards the presser foot. This guide channel has a first part formed by the vertical wall the height of which corresponds approximately to the thickness of the fabric to be sewn. This vertical wall extends toward and terminates substantially in alignment with the edge of the presser foot and to the left of the sewing axis. The guide channel also includes a second part located at a greater distance from the work surface than the first part and which also extends in the same direction and to the left of the sewing axis.

The present invention provides the advantage of being able to uninterruptedly sew profiles which have hitherto been sewn with the utmost difficulty by continuously slowing down or stopping the sewing machine to enable the operator to move the fabric on the latter and to manually remove the puckers in the fabric from the sewing area.

Other objects, features and advantages of the present invention will be made apparent in the course of the following detailed description thereof provided in reference to the accompanying drawings, in which:

DESCRIPTION OF THE PREFERRED EMBODIMENT

Figure 1:
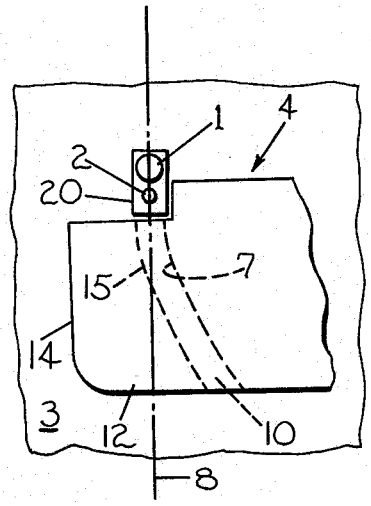
FIG. 1 is a diagrammatic view showing the location of the guide according to the invention in a sewing machine.
Figure 2:
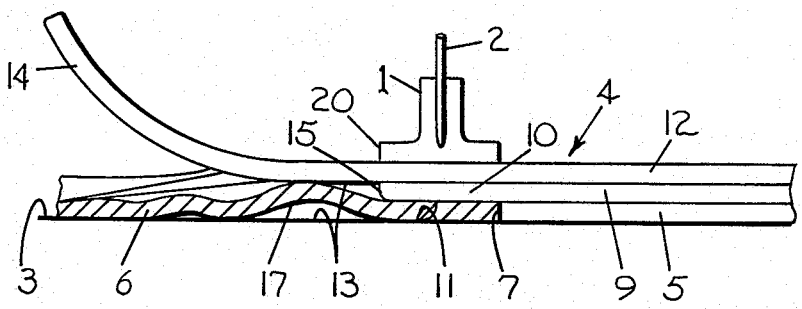
FIG. 2 is an elevational view of the guide shown in FIG. 1.

Referring specifically to FIGS. 1 and 2, enough of a conventional sewing machine is shown for an understanding of the invention which includes a presser foot 1, a needle 2 and a work surface 3. The work guide according to the invention is identified generally by numeral 4 and includes a base plate 5, the thickness of which corresponds approximately to the thickness of the fabric 6 to be sewn. This base plate 5 defines a vertical wall 7 extending from the work surface 3 forwardly of the presser foot. The vertical wall 7 being disposed normal to the work surface 3 is located on the righthand side of the sewing axis 8 and extends in a direction so as to form an acute angle with the axis 8.

An upper wall, formed by an intermediate plate 9 is attached to the upper surface of the base plate 5 and extends from the vertical wall 7 in the direction of the sewing axis 8. That portion of plate 9 extending from the vertical wall 7 is identified by numeral 10 and is esstentially the same width as the presser foot 1. Together with the vertical wall 7 and the underlying work surface 3, the part 10 forms a first part 11 of a guide channel for the fabric 6. A plate 12 is fixed to the upper surface of the intermediate plate 9 which in combination with the work surface 3 defines a second part 13 of the guide channel which has a cross-sectional configuration that is generally rectangular.

Plate 12 extends outwardly from the intermediate plate 9 and the terminus portion thereof defines an upwardly curved portion 14 that serves to facilitate insertion of the fabric in the guide channel at the commencement of each sewing operation.

As shown in FIG. 2 a rounded step 15 is formed on the outer and lower end of the intermediate plate 9 which communicates with both parts 11 and 13 of the guide channel along its entire length. Step 15 extends in the same direction as wall 7 and 15 of equal length thereto.

Figure 3:
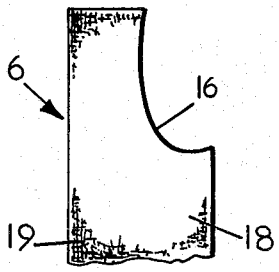
FIG. 3 shows a sample of the fabric to be sewn.

The first part 11 of the guide channel has a vertical dimension corresponding to the thickness of the fabric 6, and is adapted to keep the fabric edge 16 perfectly flat (FIG. 3) throughout the area being subjected to the sewing operation, thus preventing the puckers formed in the zone having a marked concave curvature from being inserted beneath the presser foot.

The puckers must not be allowed to advance beneath the presser foot as otherwise they would be incorporated in the seam of stitches.

The step 15 is effective, by virtue of its rounded shape, to urge the puckers 17 outwardly towards the second part 13 of the guide channel which, in turn, is adapted to contain the puckers and limit their height. Additionally the step 15 serves to compress the fabric 6 so as to keep it in contact with the vertical wall 7 and also to stretch it out on the work surface 3.

Figure 4:
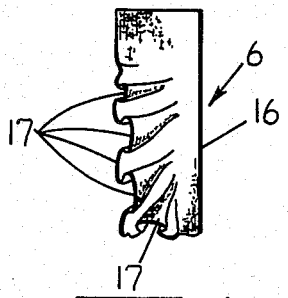
FIG. 4 shows the disposition of this sample during the sewing operation.

In general, as shown in FIG. 4, the puckers 17 cannot be avoided since edge 16 has a concave profile that is adjusted by sliding it against the vertical wall 7 so that it is disposed generally parallel to the sewing axis 8. The fabric section 18 is thus moved towards the curved extension 14, thus giving rise to upwardly directed puckering.

However, these puckers find an outlet in the second part 13 of the guide channel, thus facilitating the sliding of the fabric 6 regardless of the degree of concavity of the edge 16 to be sewn, and without the risk of the puckers 17 being inserted beneath the presser foot for they are constantly kept apart therefrom by the step 15 having a terminus portion that is disposed in alignment with the edge 20 of the presser foot 1.

Although the present invention has been described in connection with a preferred embodiment it is to be understood that modifications and variations may be resorted to without departing from the spirit and scope of the invention as those skilled in the art will readily understand. Such modifications and variations are considered to be within the purview and scope of the invention and the appended claims.

Additionally, the cross-sectional rectangular configuration of the second part 13 which is effective in limiting the height of the puckers is also effective in combination with the step 15 of exerting a force on the latter which continually urges the edge of the fabric to be seamed into contact with the vertical wall 7.

What is claimed is:

1. A guide for automatically forming a seam in a workpiece along a curved path on a sewing machine of the type having a presser foot and a work surface, said guide comprising:

(a) a base plate (5) having one side thereof defining a vertical wall (7) attached to the work surface at an angle oblique to the sewing axis;

(b) a plate member (9) fixed on said base plate (5) and extending outwardly from said wall (7) to form a first part (11) defining a guide channel having a width substantially the same as the presser foot and which extends to a position of close proximity therewith for guiding the edge of the workpiece to be seamed;

(c) a plate (12) attached to and extending for a portion of its length horizontally outward from said plate member (9) to form a second part (13) of the guide channel having a planar surface extending parallel with and spaced from the work surface for guiding that portion of the workpiece that puckers and limiting the height of the latter to effect a downward force thereon for urging that edge to be seamed against said wall (7); and (d) a rounded step (15) formed at the juncture of said first and second parts (11, 13) for maintaining the puckered portion of the workpiece being sewn within the confines of said second part (13) and clear of the presser foot.

2. The guide according to claim 1 wherein said step (15) is of a length equivalent to said vertical wall (7) and is disposed at a constant distance from the latter along its entire length.

* * * * *